US005733586A

United States Patent [19]

Herwegh et al.

[11] Patent Number: 5,733,586

[45] Date of Patent: Mar. 31, 1998

[54] SPIN BEAM FOR SPINNING A PLURALITY OF SYNTHETIC FILAMENT YARNS AND ITS MANUFACTURE

[75] Inventors: Felix Herwegh, Haltern; Friedhelm Itter; Wolfgang Schumann, both of Wuppertal, all of Germany

[73] Assignee: Barmag AG, Remscheid, Germany

[21] Appl. No.: 558,966

[22] Filed: Nov. 13, 1995

[30] Foreign Application Priority Data

Nov. 10, 1994 [DE] Germany ..... 44 40 124.8
Dec. 2, 1994 [DE] Germany ..... 44 42 946.0

[51] Int. Cl.[6] ..... B29C 47/30

[52] U.S. Cl. ..... 425/192 S; 425/131.5; 425/378.2; 425/382.2

[58] Field of Search ..... 425/131.5, 191, 425/192 S, 378.2, 382.2

[56] References Cited

U.S. PATENT DOCUMENTS

| | | | |
|---|---|---|---|
| 3,562,858 | 2/1971 | Lehner | 425/382.2 |
| 3,655,314 | 4/1972 | Lenk et al. | 425/192 S |
| 3,767,347 | 10/1973 | Landoni | 425/382.2 |
| 3,891,379 | 6/1975 | Lenk | 425/382.2 |
| 4,035,127 | 7/1977 | Ogasawara et al. | 425/192 S |
| 4,645,444 | 2/1987 | Lenk et al. | 425/192 S |
| 4,648,826 | 3/1987 | Ogasawara et al. | 425/192 S |
| 4,696,633 | 9/1987 | Lenk et al. . | |
| 5,352,106 | 10/1994 | Lenk et al. | 425/192 S |
| 5,354,529 | 10/1994 | Berger et al. | 425/192 S |

FOREIGN PATENT DOCUMENTS

| | | | |
|---|---|---|---|
| 2218239 C2 | 1/1984 | Germany . | |
| 760329 | 10/1956 | United Kingdom | 425/382.5 |
| 1 391 844 | 4/1975 | United Kingdom . | |

*Primary Examiner*—Khanh P. Nguyen
*Attorney, Agent, or Firm*—Bell Seltzer Intellectual Property Law Group of Alston & Bird LLP

[57] ABSTRACT

The invention relates to a spin beam for spinning a plurality of synthetic filament yarns, and which has the shape of an elongate, hollow parallelepiped block formed by two side walls, a lower wall, an upper wall and end walls. The spin beam includes a number of pressure-tight spin heads with downwardly extending spinnerets arranged in at least one row on a lower support. An upper support mounts at least one multiple pump which is connected, via distribution lines, to the spin heads. A pump connection plate is joined to the upper support for each multiple pump. Each of the distribution lines is connected on the one head to the pump connection plate and on the other hand to one of the spin heads, the distributing lines forming together with the pump connection plate, the spin heads, and the lower support, form a self-supporting distributor unit. The lower support forms a portion of the lower wall of the spin beam, and the side walls are mounted on the lower support of the self-supporting unit. This arrangement allows the assembly of the spin beam from inside out, and to thus produce it in a more cost-favorable manner, with more spin heads, and for easier testing.

16 Claims, 7 Drawing Sheets

SPIN BEAM FOR SPINNING A PLURALITY OF SYNTHETIC FILAMENT YARNS AND ITS MANUFACTURE

FIELD OF THE INVENTION

The invention relates to a spin beam for spinning a plurality of synthetic filament yarns, and a method of efficiently manufacturing the same.

BACKGROUND OF THE INVENTION

German Patent No. 22 18 239 discloses a spin beam of the known type wherein the spin beam is constructed as a hollow body, which is internally heated by a liquid medium. Melt lines are laid in the hollow body. The manufacture of such a spin beam is very expensive.

It is therefore the object of the invention to further develop the spin beam, so as to simplify its manufacture and to ensure that the melt carrying components, which are under a very high pressure (more than 100 bars), can be made pressure tight and tested in a simple manner.

SUMMARY OF THE INVENTION

The invention is characterized in that, departing from conventional manufacturing methods, the spin beam is not constructed as a hollow body, in which the line systems are subsequently installed. Rather, the spin beam is constructed from the inside out, in that initially the melt carrying parts are assembled as a self-supporting structural unit, and the spin beam is subsequently constructed around this structural unit. This allows a structural unit containing the melt carrying parts to be manufactured first, and to perform on this unit the necessary and desired pressure and quality tests, without being thereby hindered by the housing.

More particularly, the present invention relates to a spin beam for spinning a plurality of synthetic filament yarns, which has the shape of an elongate, hollow parallelepiped block, and which is formed by two side walls, a lower wall, an upper wall, and end plates. The lower wall includes a lower support and the upper wall includes an upper support. The spin beam also includes: (a) a plurality of pressure-tight spin heads with downwardly directed spinnerets arranged in at least one row on the lower support; (b) at least one multiple pump arranged on the outward side of the upper support; (c) at least one pump connection plate joined to the underside of the upper support and operatively associated with a respective one of the at least one multiple pump; and (d) a plurality of distribution lines for distributing the melt. Each distribution line has one end connected to the pump connection plate and an opposite end connected to a respective one of the plurality of spin heads. The plurality of distribution lines, together with the one pump connection plate, the spin heads, and the lower support, form a self-supporting distributor unit which is adapted to be independently pressure tested before being fabricated with the remaining components of the spin beam.

A far reaching prefabrication of the spin beam and its stability can be achieved in that especially the side walls of the spin beam are constructed as channel sections.

In one embodiment of the present invention, the upper support of the spin beam is cross-sectionally constructed in U-shape with its sides directed upwardly. The side walls of the upper support being welded to the transverse walls of the side walls of the spin beam. This embodiment serves likewise both the stability and the simplified manufacture. It guarantees in particular a dimensional accuracy of the upper support carrying the pump connection and other connections. The same applies to the configuration wherein the lower support is cross-sectionally constructed in U-shape, and its side walls are connected in a pressure tight manner to the transverse walls of the spin beam side walls. In this embodiment, the side walls of the lower support may be made so long that they enclose between them the spin heads and, thus, provide for a satisfactory heat control in the spin heads. In this arrangement, it is provided in particular that the side walls of the lower support are welded at their bottommost edges to the walls extending transversely from the side walls forming the spin beam. The thus-formed box encloses the U-shaped section of the lower support on all sides, and leaves open only the opening of the U-shaped section for the exit of the filaments.

Another embodiment of the present invention achieves a further improvement of heat control in the spin heads. In this embodiment, the lower support is constructed as a solid, metallic parallelepiped block. Each distribution line is welded in a pressure tight manner respectively to the lower support via a connection plate extension. The lower support has an opening for each extension into which the extension is inserted and each extension is joined to a connection plate. The openings enclose the spin heads leaving a small gap between each extension and the lower support. It is preferred that the lower edges of the lower support be welded to the transverse wall portions of the side walls forming the spin beam, so that the box encloses the lower support on three sides.

In one embodiment of the invention, the distributor unit is connected to the lower support via a special connecting plate. The advantage lies in that the connection of the spinneret to the respective distribution line becomes independent of the relatively coarse tolerance, at which the lower support is made at a moderate cost of manufacture. To this end, the connecting plate may be mounted on the downwardly facing side of the base plate of the lower support. However, for a connection of round spin heads it is especially suitable to use an extension which extends freely downward and which has a screw thread or bayonet joint attachment means on its lower portion for releasably connecting each spin head.

The spin beam of the invention has the further, special advantage that it can be made in any desired size, i.e., the possibilities of manufacture and construction do not limit the size. For this reason, the spin beam can also accommodate several distributor units, which are each supplied by one multiple pump. Until now, for supplying several pumps with melt that advances from an extruder, it has been necessary to provide a complicated line system, in which each line is surrounded by a double jacket, so that the inner melt line is heated by an external jacket of vapor or fluid. The cost of such double-jacket pipes is especially high, when all lines between the extruder and the respective pump are to be of the same length, i.e., when the pipes must be bent.

This problem is eliminated by a further embodiment of the invention wherein the spin beam has a plurality of multiple pumps which are arranged in a predetermined spatial relationship on the upper support. A melt supply line extends into the spin beam and is divided into a plurality of pump lines corresponding to the number of pumps, with each pump line extending within the spin beam to one of the pump connection plates and thereby connected to a respective pump. In this embodiment, the melt lines leading into the spin beam, the so-called "melt distributor block", which forms the end of the melt supply line, as well as the pump lines leading to the individual pumps are connected to the respective pump connection plate and integrated to a distributor unit.

In the following, several specific embodiments of the invention are described. In this context, certain preferred sequences in the construction of spin beams that are considered especially favorable will be indicated by way of example. However, several sequences are feasible in the construction of the outer walls of the spin beam and for their mounting to the prefabricated, self-supporting distributor unit, since in the construction of a parallelepiped box it does not necessarily matter how the walls are placed on top of each other. Therefore, the invention also includes modified sequences with the same result. The foregoing and other objects and aspects of the present invention are explained in detail in the specification set forth below.

DETAILED DESCRIPTION OF THE INVENTION

Figure 1:
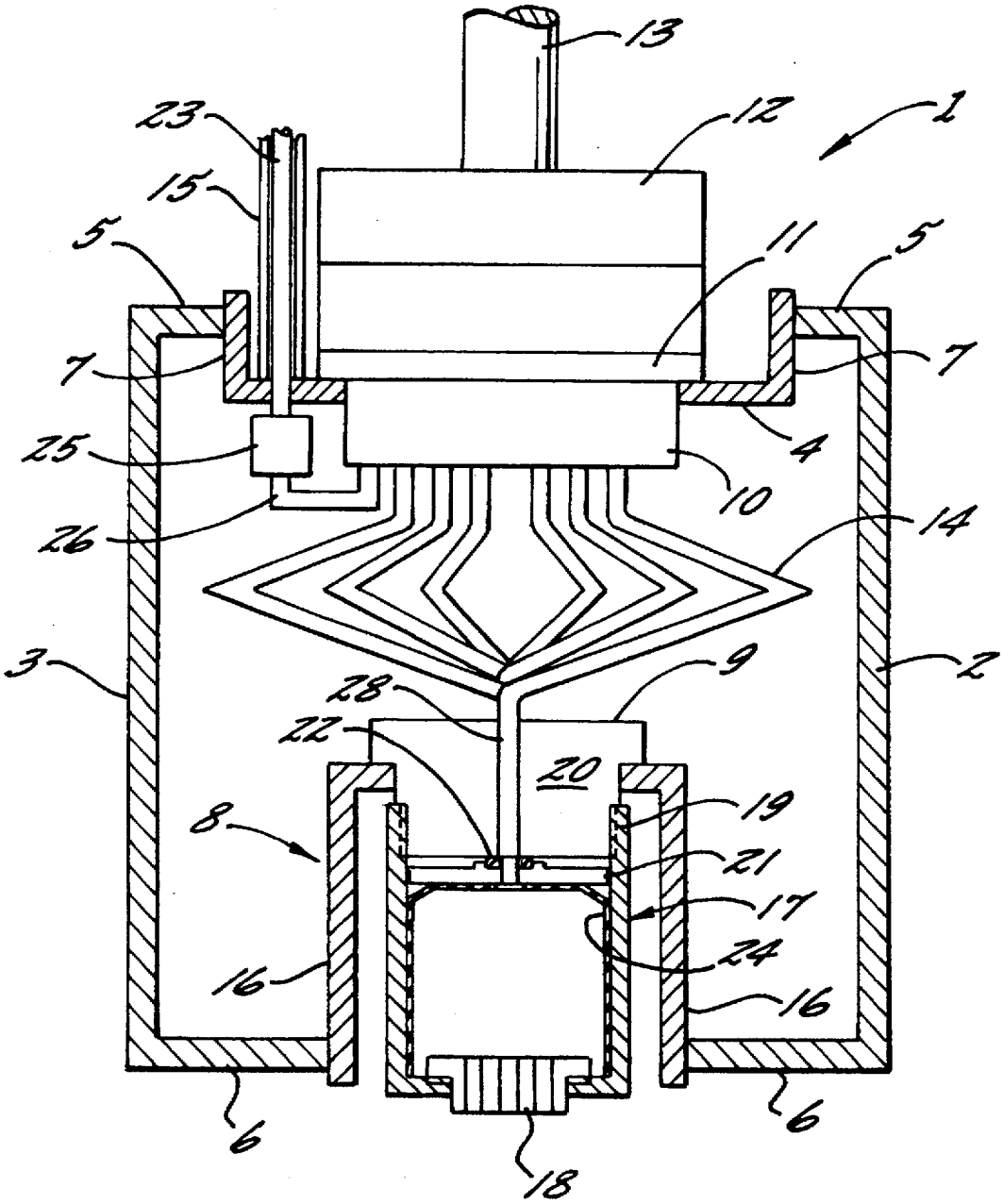
FIG. 1 is a schematic, cross sectional view of a first embodiment.

The following description applies to all embodiments. Deviations will be specifically indicated.

A spin beam 1 is formed by two side walls 2 and 3 as well as by an upper support 4 and a lower support 8. The side walls 2 and 3 are made with a U-shaped cross section, their horizontal transverse walls 5 and 6 forming respectively a portion of the upper wall and the lower wall of spin beam 1. The upper support 4 has likewise a U-shaped cross section. It extends over the entire length of the spin beam 1. Over its length, it is provided in its base plate with several openings, which serve for receiving a pump connection plate 10, as will be described further below.

With its side walls 7 the upper support 4 is welded respectively to the transverse walls 5 of side walls 2 and 3. The U-shaped opening of the upper support 4 is directed upwardly. Its upwardly directed base surface of the channel section mounts in pressure-tight manner, via an intermediate plate 11, a multiple pump 12 on a connection plate 10. The multiple pump 12 is driven by a pump shaft (drive shaft) 13. The multiple pump 12 is a gear pump, in which a melt flow is distributed over several pump chambers and thereafter distributed over several melt distribution lines 14.

One melt supply line 23 extends into spin beam 1. This melt supply line 23 extends through the base plate of upper support 4 and connects then to a distributor 25. From distributor 25, the melt is distributed over melt delivery lines 26, each of which leads to the pump connection plate 10 of each of the pumps.

In the embodiment having a total of twelve spinnerets, two pump connection plates 10 and two multiple pumps 12 are provided. Each pump connection plate 10 has a plurality of holes extending therethrough and overlies six spinnerets 18 in the center thereof. Through melt delivery line 26, the melt flows to multiple pump 12, the latter distributing the melt to six distribution lines 14. Each distribution line 14 leads to one spinneret 18, by terminating, via a channel 28, in spin head 17.

Figure 3:
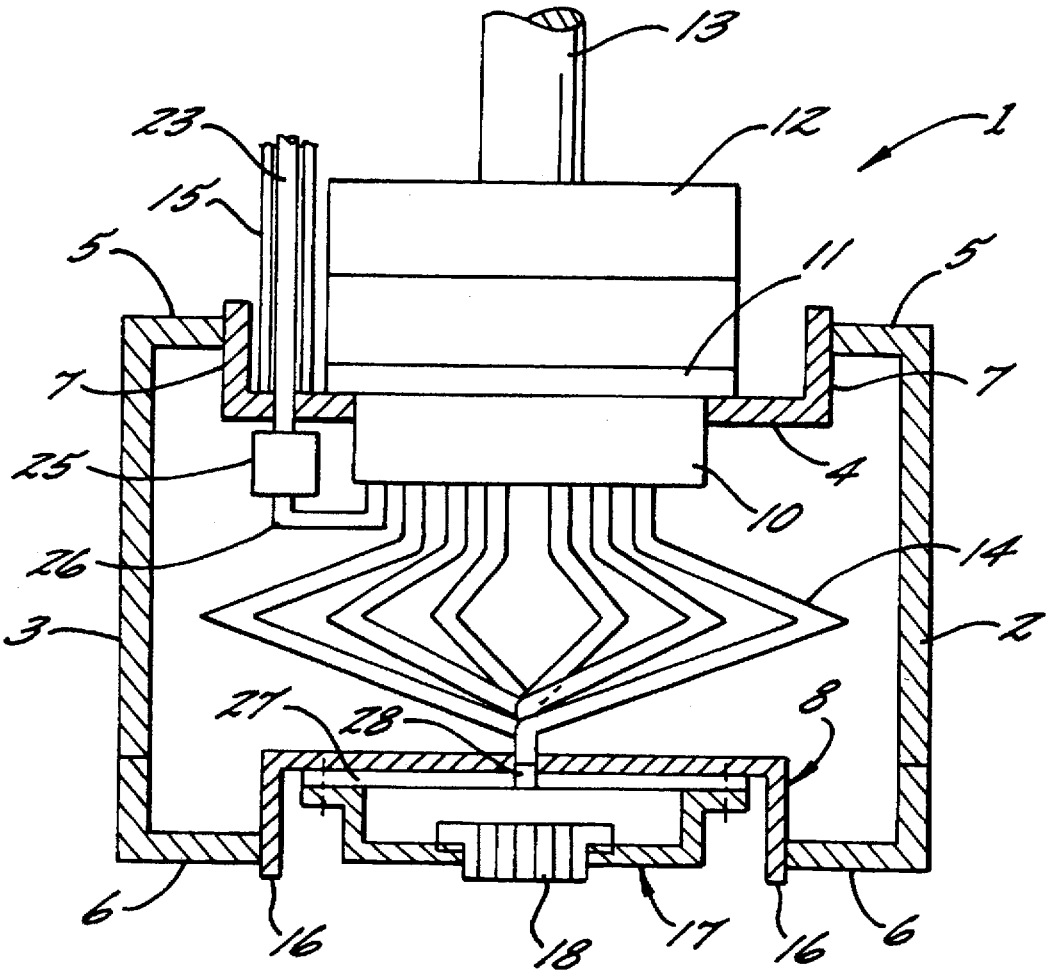
FIG. 3 is a schematic, cross sectional view of a third embodiment.
Figure 5:
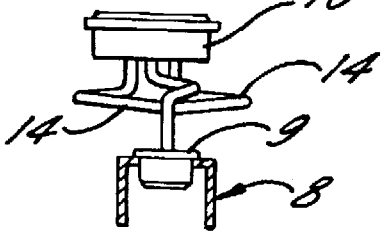
FIG. 5 is a side view of the distributor unit of FIG. 4 from the left.

It should be emphasized that in all embodiments the spin head 17 may be constructed with identical round spinnerets. In the embodiment of FIG. 3, the spin head 17 is rectangular in its horizontal section. The spin heads 17 are mounted on lower support 8.

In the embodiment of FIG. 1, the lower support 8 has a U-shaped cross section. The side walls 16 of U-shaped support 8 are directed downwardly, and they are welded at their lower edge to the transverse walls 6 of side walls 2, 3. The base plate of support 8 has several holes, which are equally spaced apart from one another, for example twelve holes, as will be described further below. Inserted into these holes and welded to support 8 are connection plates 9. Each of connection plates 9 extends with an extension 20 into the U-shaped opening of support 8. On its peripheral surface, the extension 20 is provided with a screw thread. Connected to this screw thread by screwing is spin head 17, which has a correspondingly mating screw thread on its inner surface. Inserted into the bottom of spin head 17 is a spinneret 18. A piston 21 is operative in the spin head 17. This piston 21 is sealed against the lower extension 20 of connection plate 9 by a round seal 22 which surrounds a supply line 28. On its side facing spinneret 18, the piston 21 is sealed by a diaphragm 24. The melt line extends through the piston and the diaphragm in the center thereof. In the pressureless state, the diaphragm rests against the piston under a slight expansion force, and pushes it by means of seal ring 22 against the lower front end of extension 20 of connection plate 9. Under the pressure of the melt entering into the spin head 17, diaphragm 24 lies against the piston and the gap surrounding this piston, and thereby seals the piston. At the same time, seal ring 22 is pressed under the necessary sealing force against extension 20 of connection plate 9. The spin pack accommodated in spin head 17 is thus preferably self-sealing. A spin head of this general type is further illustrated and described in U.S. Pat. No. 4,696,633, which is incorporated herein by reference.

Figure 2:
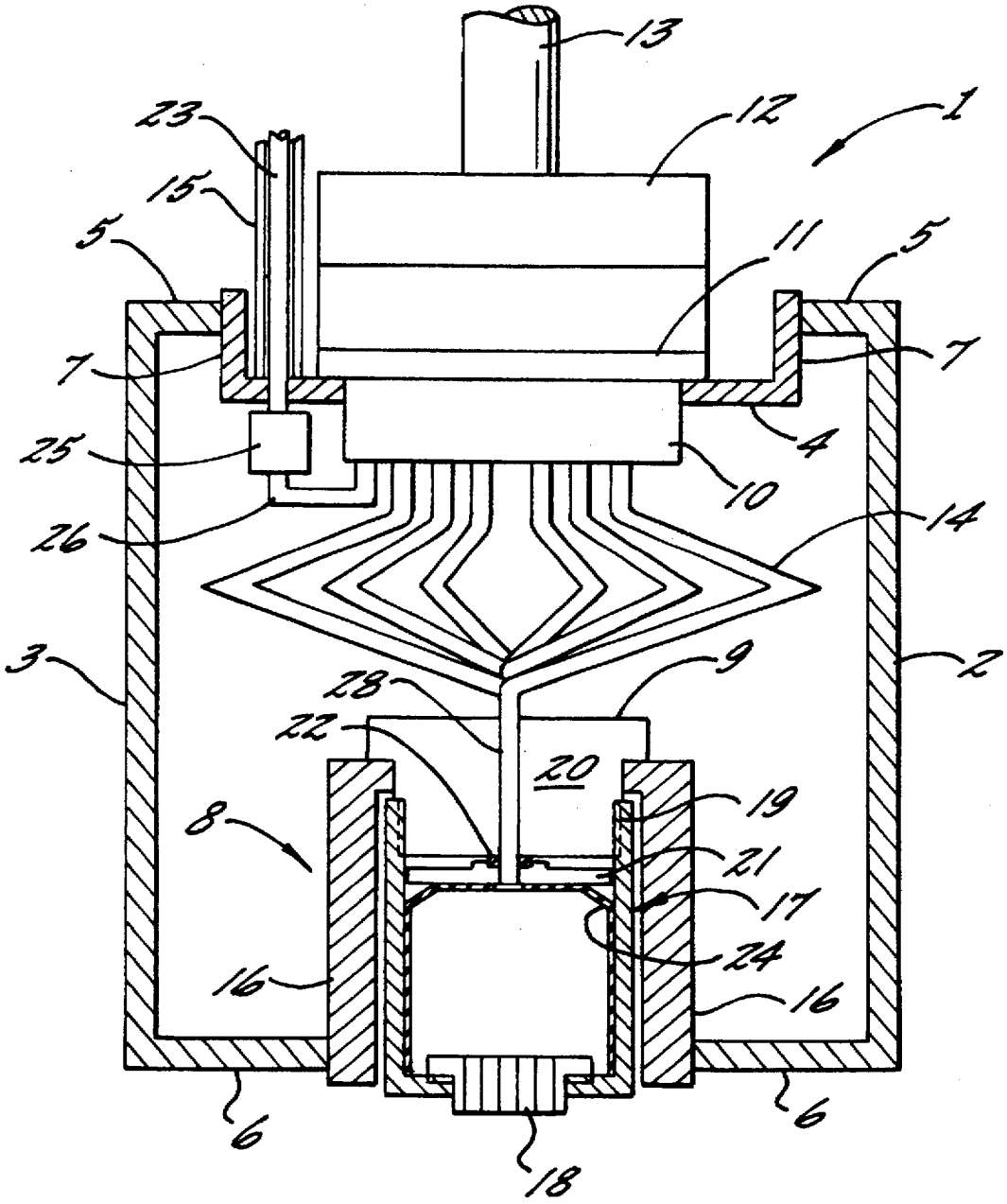
FIG. 2 is a schematic, cross sectional view of a second embodiment.

In the embodiment of FIG. 2, the lower support 8 is constructed as a solid, parallelepiped metal block. This block is penetrated by a number of holes, twelve in the embodiment. The upper side of each hole is closed by connection plate 9. The lower extension 20 of connection plate 9 extends downwardly into the hole. Again, as described above, this extension can receive a spin head 17 by screwing it thereto. The spin head is identical with that of FIG. 1 and its pertinent description.

In the embodiment of FIG. 3, the lower support 8 is constructed as a relatively wide channel section. The vertical walls 16 of the channel section are welded to the transverse walls 6 of side walls 2 and 3. The underside of the base plate of support 8 mounts a connection plate 27. Bolted in a pressure-tight manner to the underside of this connection plate 27 is the rectangular spin head 17. In spin head 17, one of the melt supply lines 28 terminates by extending through the base plate of support 8 as well as connection plate 27. Inserted into the bottom of spin head 17 is a rectangular spinneret 18.

In all embodiments, two distributor units serve as the essential operative elements and simultaneously as structural components of the spin beams. The distributor units are constructed first and tested for pressure tightness. In the embodiments of FIGS. 1 and 2, each distributor unit consists of the lower support 8, the twelve connection plates 9 joined thereto by welding, the twelve melt supply lines 14 welded thereto, and the pump connection plate 10. The melt supply line 26 leads to melt distributor 25, and each of the melt distribution lines 14 leads to the pump connection plate 10, with the lines 14 being in communication with respective ones of the holes in the plate 10.

Initially, the melt distribution lines 14 are made of the same length, and then bent, so that their ends have each the predetermined distance between pump connection plate 10 on the one hand and one of the spinneret connection plates 9 on the other. These ends are then welded to each of these plates. Subsequently, all connection plates 9 are inserted into the corresponding holes provided in the base plates of the lower support 8 and welded thereto. Furthermore, the melt delivery lines 26 are made of the same length and bent, so that their ends have each the predetermined distance between melt distributor 25 and each of the pump connection plates 10. Subsequently, the ends are welded to pump connection plate 10 on the one hand and melt distributor 25 on the other. Further welded to melt distributor 25 is melt line 23, which is to extend later through the upper support.

Figure 4:
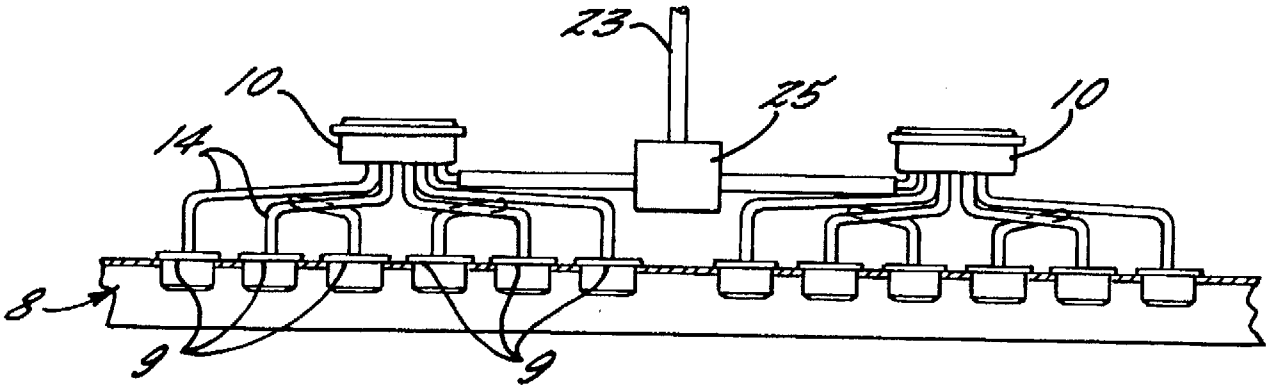
FIG. 4 is a front view of a distributor unit.

As shown in FIG. 4, in this manner a complete distributor unit is formed for a total of twelve spinnerets, from which twelve yarns can be spun. This distributor unit can be constructed without obstruction by components surrounding same, and be tested in particular for compressive strength and tightness.

Figure 6:
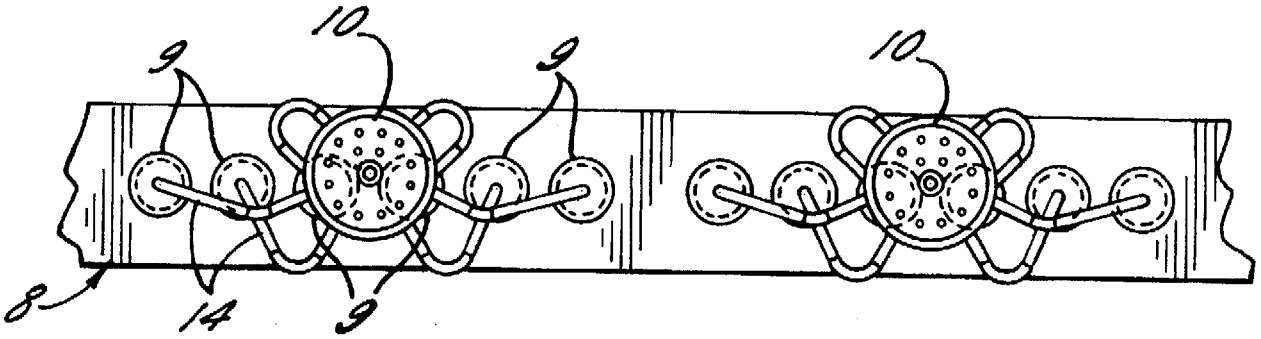
FIG. 6 is a top view of the distributor unit of FIG. 4.
Figure 8:
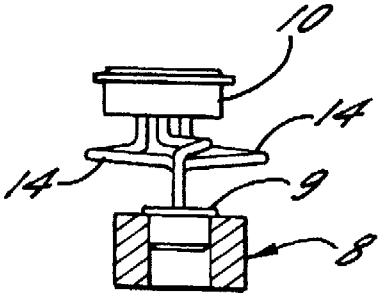
FIG. 8 is a side view of the distributor unit of FIG. 7 from the left.

FIG. 6 is a top view illustrating the layout of the melt distribution lines 14 leading from pump connection plate 10 to the individual connection plates 9.

Figure 7:
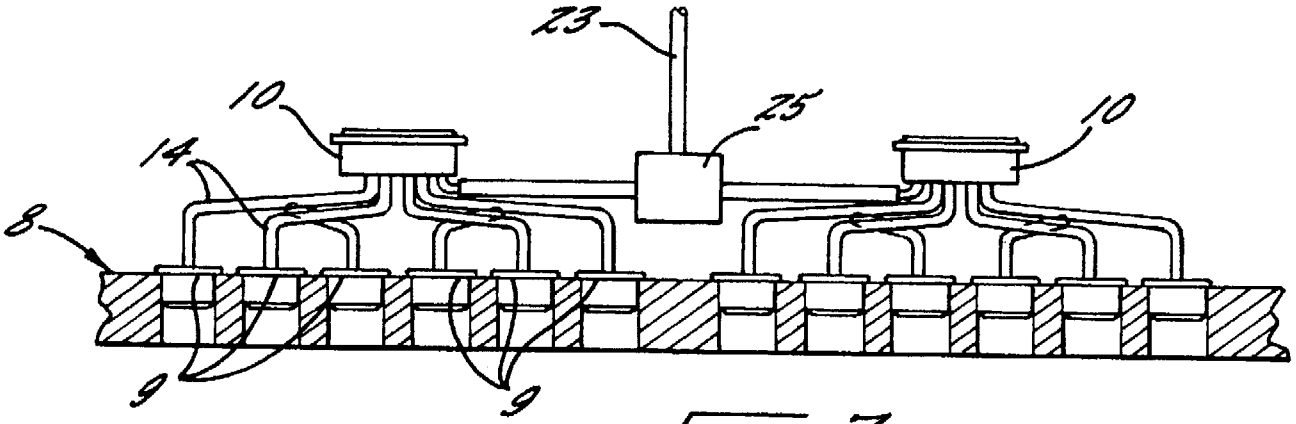
FIG. 7 is a front view of a further embodiment of a distributor unit.
Figure 9:
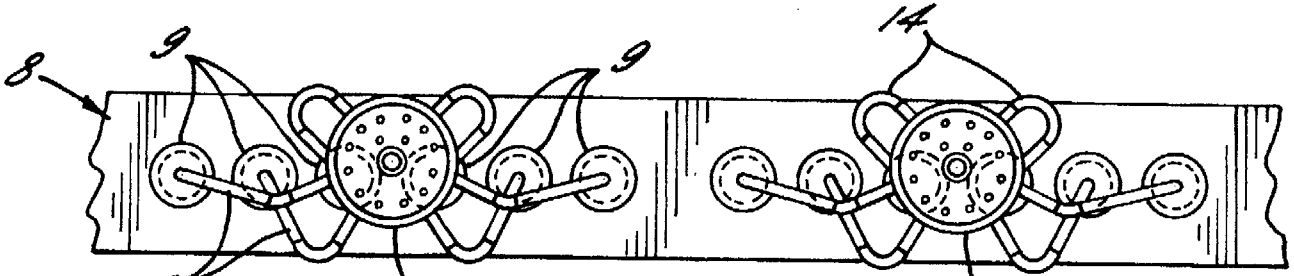
FIG. 9 is a top view of the distributor unit of FIG. 7.

FIG. 7 corresponds to FIG. 4 for the embodiment of FIG. 2, wherein the lower support 8 is constructed as a solid block with holes.

Figure 10:
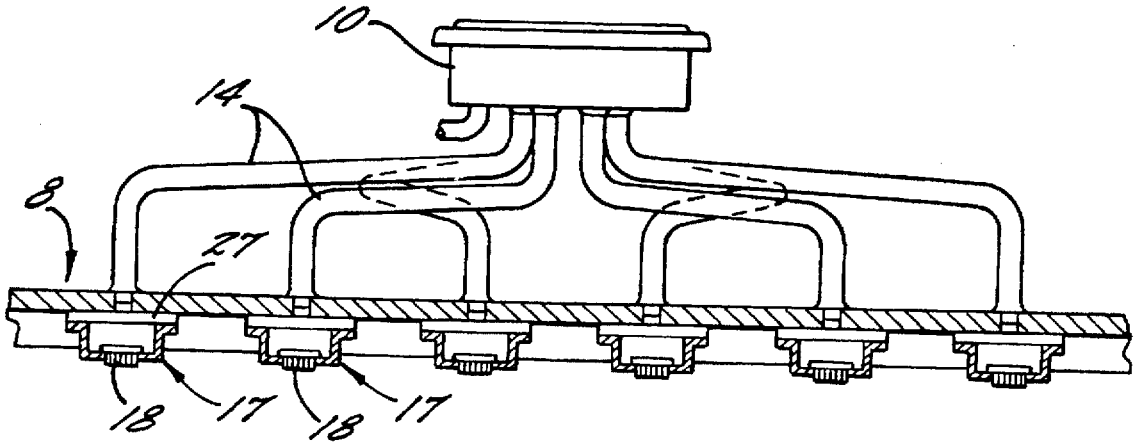
FIG. 10 shows a distributor unit for a spin beam of FIG. 3.
Figure 11:
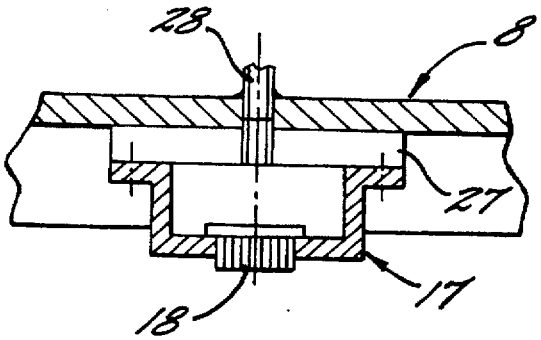
FIG. 11 shows a detail of the distributor unit of FIG. 10.

FIG. 10 illustrates a distributor unit for the embodiment of FIG. 3, which has no connection plates 9, but in which the melt distribution lines 14 are welded each to smaller holes provided in the base plate of lower support 8.

Figure 12:
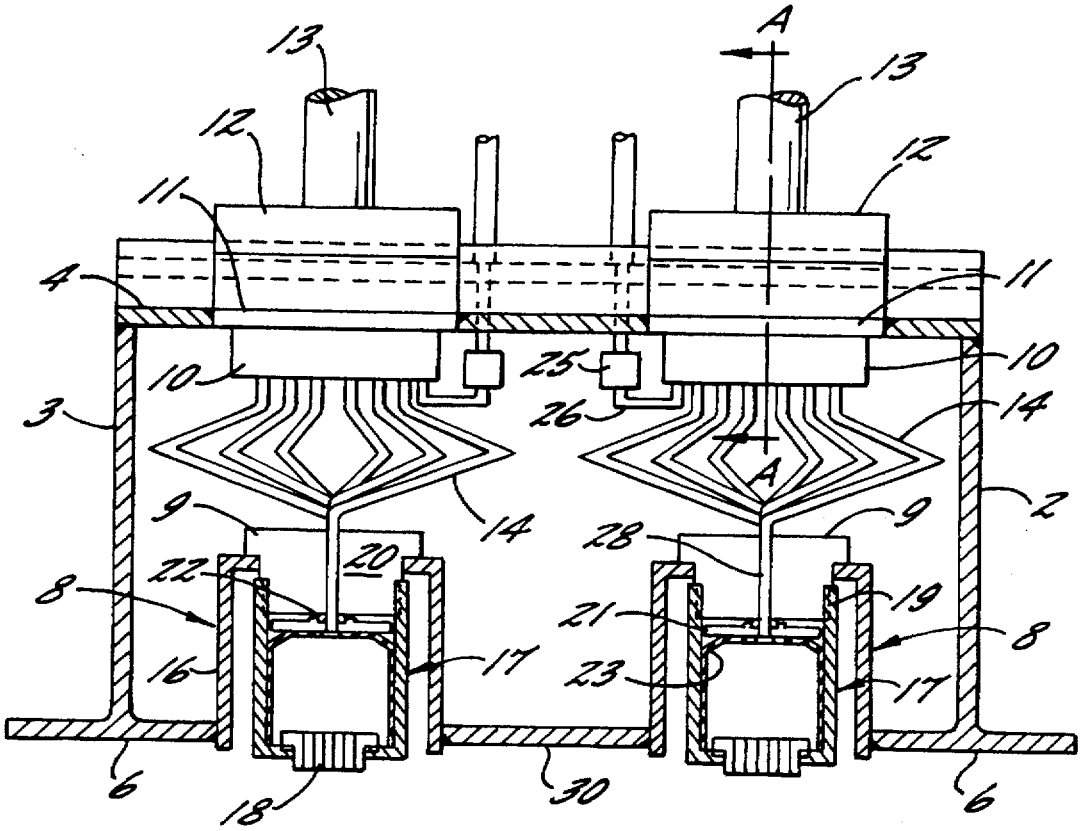
FIG. 12 shows a further embodiment of a spin beam with two rows of spinnerets.

In the spin beam of FIG. 12, two rows of spinnerets 18 are arranged parallel to each other on the underside of spin beam 1. Each row of spinnerets 18 is supplied via a distributor unit and one of pumps 12. As regards the construction of the distributor units, the foregoing descriptions are herewith incorporated by reference. Illustrated is an embodiment in accordance with FIG. 1 and FIG. 4. The lower support 8 is present in duplicate. Shown are lower supports 8 corresponding to FIG. 1. Possible, however, is also a configuration corresponding to FIG. 2 or FIG. 3.

The construction of the upper support of FIG. 12 differs from the embodiments of FIG. 1, 2, or 3. The upper support 4 is a channel section with a base plate and side walls 7. The upper support 4 extends crosswise to the axial direction of spin beam 1 between the two side walls 2 and 3. The upper support 4 has in its bottom two holes, adapted to receive pump connection plate 10 with intermediate plate 11. Upon completion of the two distributor units, the upper support 4 is tightly welded to the two pump connection plates 10 or intermediate plates 11 of the two distributor units.

In the illustrated embodiment, the side walls 2 or 3 have transverse walls 6 each extending perpendicularly from side wall 2 or side wall 3. The side walls 2, 3 together with their transverse walls 6 are welded to one of the lower supports 8. The upper end of the spin beam is formed by upper support 4 as well as laterally adjacent cover plates 29.

Figure 13:
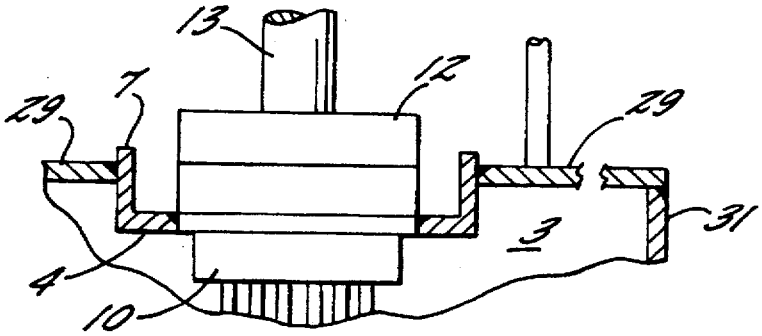
FIG. 13 is partial sectional view along line A—A of FIG. 12.
Figure 14:
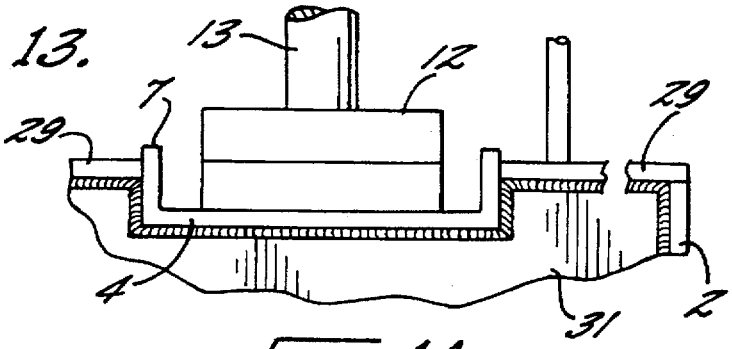
FIG. 14 is a front view of the spin beam of FIG. 12.

In the case of this spin beam with two parallel rows of spinnerets, the construction principle of this invention is of special importance. It allows to assemble first the distributor units each individually and to test same for tightness. This test would not be possible, were the approach different. Only upon completion and testing the distributor units is the spin beam assembled, in that the distributor units are initially interconnected by upper support 4, and that the lower supports 8 are then joined to the side walls 2, or vice versa. Subsequently the upper support 4 is welded to the side walls 2 and 3. As shown in FIG. 13, the side walls 2, 3 have a recess in their upper edge which is adapted to receive the upper support 4 with its side walls 7.

Subsequently, the spin beam is closed by cover plates 29 on its upper side, and by an intermediate plate 30 between the two lower supports 8, as well as by end plates 31 at the axial ends of the spin beam.

All embodiments of the spin beams are closed at their axial ends by end plates 31.

Referring to all embodiments, upon completion of the distributor units, the assembly continues in that the pump connection plates and upper plate 11 are joined to one another, and that melt line 23 is welded into the upper plate so as to extend therethrough. A double jacket 15 that surrounds the melt line 23 and forms therewith an annular space, is welded to the upper plate such that the annular space terminates at the upper plate. The annular space is supplied with a heating medium.

Subsequently, the transverse walls 5 and 6 of side walls 2, 3 are welded respectively to the upper and the lower support, thereby forming the parallelepiped beam. It should be remarked that a vapor line for heating the spin beam and a condensate drain line not shown terminate in the hollow space of the spin beam. The vapor permits a uniform heating inside the spin beam.

That which is claimed is:

1. A self supporting melt distributor unit which is adapted to form a component of a melt spin beam and which may be independently pressure tested before fabrication of the spin beam is completed, and comprising an elongate lower support member, connection plate means mounted to said lower support member, with said connection plate means including a plurality of openings therethrough which extend along at least one row, a pump connection plate 10 mounted in spaced relation from said lower support member and having a plurality of melt delivery holes extending therethrough, and a plurality of melt distribution lines interconnecting each of the melt delivery holes in said pump connection plate with respective ones of the openings of the connection plate means, each of said melt distribution lines comprising a separate tube along its entire length between the associated hole in the pump connection plate and the associated opening of the connection plate mean.

2. The melt distributor unit as in claim 1 wherein said plurality of melt distribution lines are of substantially equal length.

3. The melt distribution unit as in claim 2 wherein said connection plate means is configured to mount a plurality of melt spin heads which communicate with respective ones of the openings of said connection plate means.

4. The melt distribution unit as in claim 2 further comprising a melt delivery line connected to a melt delivery opening in said pump connection plate so as to be adapted to deliver a melt to at least one of said melt delivery holes in said pump connection plate.

5. The melt distribution unit as in claim 2 wherein said lower support member has the cross sectional configuration of an inverted U so as to define a bottom wall and opposite side walls, and wherein said connection plate means is mounted to said bottom wall of said lower support member.

6. The melt distribution unit as in claim 5 wherein said connection plate means comprises a plurality of separate connection plates, wherein said bottom wall includes a plurality of openings which receive respective ones of said connection plates, and wherein each of said connection plates includes an externally threaded extension for releasably mounting a spin head thereto.

7. A spin beam adapted for spinning a plurality of synthetic filament yarns and which has the shape of an elongate, hollow parallelepiped block, and comprising first and second side walls, a lower wall, an upper wall, and opposite end plates, wherein said lower wall includes a lower support and said upper wall includes an upper support, a plurality of pressure-tight spin head assemblies arranged in at least one row on the lower support, with each spin head assembly including a downwardly directed spinneret;

at least one multiple pump connected to the upper support;

at least one pump connection plate joined to the upper support of said upper wall and operatively connected with said one multiple pump, said one pump connection plate having a plurality of melt delivery holes extending therethrough;

a plurality of distribution lines for distributing melt, each distribution line comprising a separate tube having one end connected to a respective one of the holes of said one pump connection plate and an opposite end connected to a respective one of said plurality of spin head assemblies;

wherein said plurality of distribution lines, said at least one pump connection plate, said plurality of spin head assemblies, and said lower support form a self-supporting distributor unit which is adapted to be independently pressure tested before being fabricated with the remaining components of the spin beam.

8. A spin beam as in claim 7, wherein said first and second side walls of the spin beam each have an inwardly directed U-shaped cross-sectional configuration, and wherein each of said first and second side walls have horizontal transverse walls at the bottom and top thereof forming respectively a portion of the lower wall and upper wall.

9. A spin beam as in claim 8, wherein the upper support is cross sectionally constructed in U-shape with upwardly directed side walls and wherein the upper support side walls are welded to the top transverse walls of said first and second side walls.

10. A spin beam as in claim 8 wherein the lower support is cross sectionally constructed in U-shape with downwardly directed side walls, and wherein said lower support side walls are connected in a pressure-tight manner to the bottom transverse walls of said first and second side walls.

11. A spin beam as in claim 7 wherein each of said head assemblies further includes a connection plate having an opening extending therethrough, with the associated spinneret being connected to the connection plate so as to communicate with the opening thereof.

12. A spin beam as in claim 11 wherein each of said connection plates includes an extension extending through an opening in said lower support, with each of said extensions having means releasably connecting the associated spinneret thereto.

13. A spin beam as in claim 12, wherein each connection plate extension and its associated connection plate form one structural unit.

14. A spin beam as in claim 11 wherein the lower support includes a base plate, wherein the connection plate of each of said spin head assemblies is mounted below the base plate, and wherein each spin head assembly includes an opening extending through the base plate which communicates with the opening of the associated connection plate.

15. A spin beam as in claim 7, wherein said at least one multiple pump comprises a plurality of multiple pumps arranged in a predetermined spatial relationship on the upper support, wherein one of said pump connection plates is operatively connected with each of said multiple pumps, and wherein a melt supply line extends into the spin beam and is then divided into a plurality of pump lines corresponding to the plurality of multiple pumps, with each pump line extending within the spin beam and connected to one of said respective pump connection plates and thereby operatively associated with said respective multiple pump for distributing melt in the spin beam.

16. A spin beam as in claim 7, wherein the spin beam is thermally insulated.

* * * * *